US011957247B2

(12) United States Patent
Schneidewent

(10) Patent No.: US 11,957,247 B2
(45) **Date of Patent: *Apr. 16, 2024**

(54) UNDER-BED STORAGE UNIT FREESTANDING

(71) Applicant: Edward Schneidewent, Milwaukee, WI (US)

(72) Inventor: Edward Schneidewent, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/480,187

(22) Filed: Sep. 21, 2021

(65) Prior Publication Data

US 2022/0071403 A1 Mar. 10, 2022

Related U.S. Application Data

(63) Continuation-in-part of application No. 16/184,094, filed on Nov. 8, 2018, now Pat. No. 11,147,387.

(51) Int. Cl.
*A47C 17/86* (2006.01)
*A47B 49/00* (2006.01)

(52) U.S. Cl.
CPC ..... *A47C 17/86* (2013.01); *A47B 49/004* (2013.01)

(58) Field of Classification Search
CPC ..... A47B 11/00; A47B 23/00; A47B 23/02; A47B 23/025; A47B 49/004; A47B 49/006; A47C 17/52; A47C 17/54; A47C 17/56; A47C 17/58; A47C 17/60; A47C 17/62; A47C 17/86; A47C 19/22
USPC ..... 108/42, 49, 50.11, 93; 312/306
See application file for complete search history.

(56) References Cited

U.S. PATENT DOCUMENTS 3,618,145 A * 11/1971 Rowe ..... A47B 23/025 5/507.1
3,711,875 A * 1/1973 Cox ..... A47C 17/00 5/2.1
4,597,122 A * 7/1986 Handler ..... A47B 88/41 5/503.1
5,474,377 A * 12/1995 Cone ..... A47C 17/86 248/131
5,813,736 A * 9/1998 Ballew ..... A47B 96/04 312/348.3
6,292,960 B1 * 9/2001 Bowling ..... A47C 17/86 5/931
6,502,256 B1 * 1/2003 McNeil ..... A47B 88/463 312/319.1
6,721,969 B1 * 4/2004 Lupo ..... A47C 17/86 5/9.1

(Continued)

*Primary Examiner* — Joshua E Rodden

(57) ABSTRACT

An under-bed storage unit is disclosed in which a freestanding structure is disposed under a bed frame and bears a generally circular platform thereon. The platform has a cut edge configured to be flush with the margin of the bedframe so that when the platform is not in use, it does not extend beyond the bed frame and is therefore out of the way. However, upon rotation, the arc of the circular platform is exposed and the stored contents of the platform are visible and accessible. The platform is rotated until the desired stored item is located and is then returned to its stored position. A number of variations of under-bed storage units utilizing freestanding supports, platforms of various sizes and shapes, structural and aesthetic platform feature, and associated support structures are also disclosed.

29 Claims, 20 Drawing Sheets

(56) References Cited

U.S. PATENT DOCUMENTS

| | | | | |
|---|---|---|---|---|
| 8,286,280 | B1 * | 10/2012 | Matos | A47D 11/005 5/2.1 |
| 8,943,624 | B1 * | 2/2015 | Youngstrom | A47C 17/52 5/2.1 |
| 10,849,805 | B1 * | 12/2020 | de Isaza | A61G 7/047 |
| 2010/0319120 | A1 * | 12/2010 | Woodhams | A47C 19/22 5/2.1 |
| 2011/0094030 | A1 * | 4/2011 | Harrington | A47C 17/86 5/503.1 |
| 2017/0042336 | A1 * | 2/2017 | Craver | F16B 12/14 |
| 2019/0142176 | A1 * | 5/2019 | Schneidewent | A47C 17/86 5/503.1 |
| 2019/0191889 | A1 * | 6/2019 | Flora | A47B 85/08 |

* cited by examiner

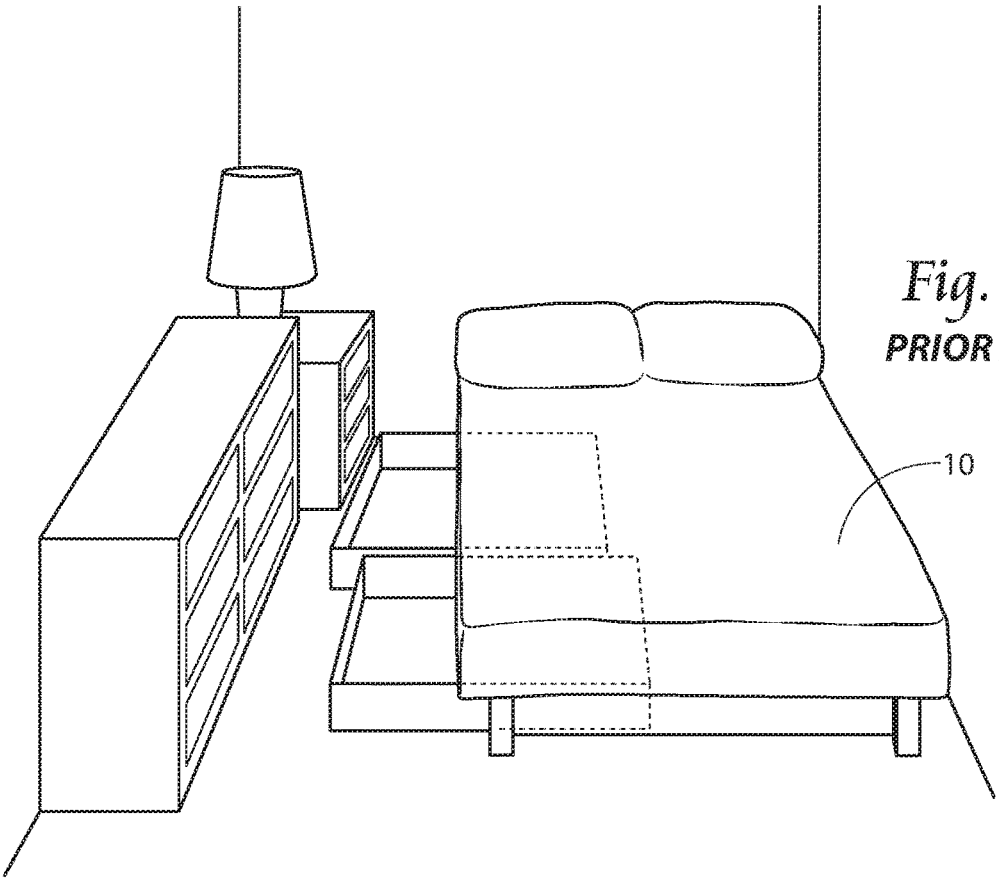
Fig. 8
PRIOR ART
Fig. 9
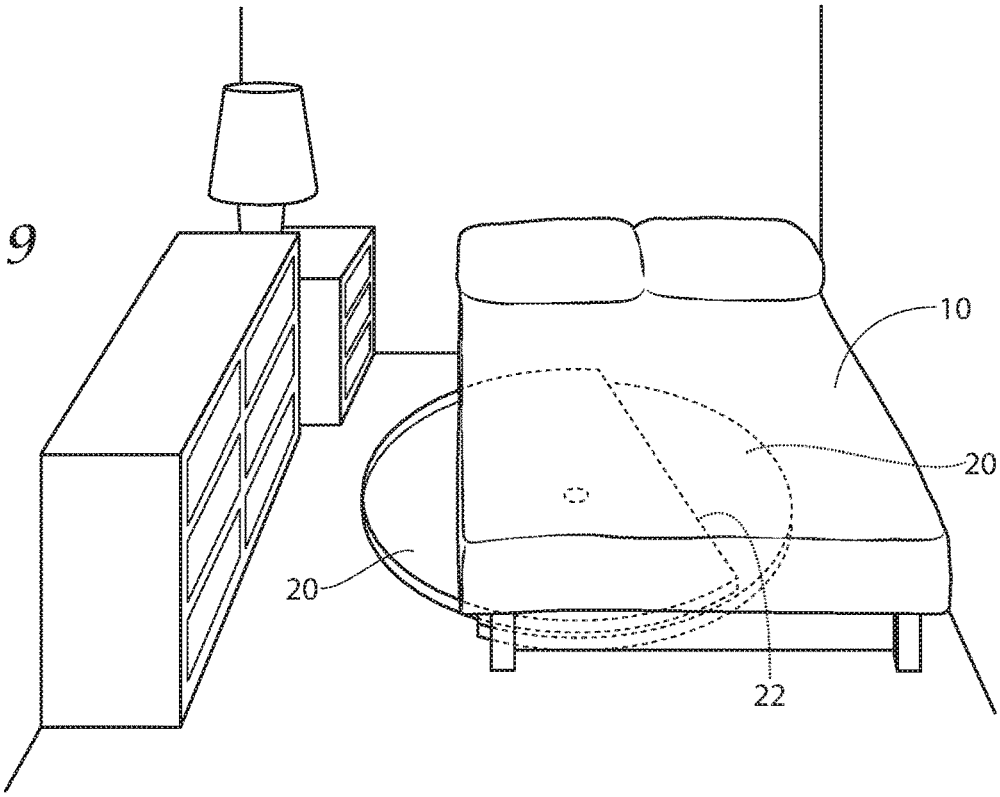

UNDER-BED STORAGE UNIT FREESTANDING

RELATED APPLICATION

This application is a Continuation-In-Part of application Ser. No. 16/184,094, now U.S. Pat. No. 11,147,387, which claims the benefit of provisional application Ser. No. 62/585,363, filed 13 Nov. 2017.

BACKGROUND OF THE INVENTION

In many homes and apartments, storage space is lacking. One of the ways to address this problem is to utilize wasted space such as under one's bed. There are many examples of under-bed storage boxes, bags, baskets, and the like that can be pulled out from under a bed for access to the stored contents. However, especially in very tight spaces, access to under-bed storage can still be difficult.

In addition, most prior art solutions focus on long-term storage rather than everyday use. Out of season clothing, decorations, or bedclothes only need to be stored/accessed once a year or so such that ready access to items is not critical. These are "out-of-sight, out-of-mind" storage devices, and can be flimsy and unattractive since frequent access is not required.

However, for under-bed storage of items such as shoes or shirts, which will be retrieved at least once a day if not more frequently, ease of access and durability are essential. Since the user will see the storage device on at least a daily basis, aesthetics are also more important.

SUMMARY OF THE INVENTION

The present invention is directed to an under-bed storage unit that maximizes under-bed storage space without requiring a user to get on the floor to access the storage unit. A rotating storage platform positioned under the bedframe is proposed, which permits the majority of the storage area to be accessible from outside the margin of the bedframe while still being fully accessible from above.

A generally circular platform having a cut edge creates a storage platform with a flat edge. The flat edge is configured to be flush with the margin of the bedframe so that when the platform is not in use, it does not extend beyond the bed frame and is therefore out of the way.

However, upon rotation, the arc of the circular platform is exposed and the stored contents of the platform are visible. The platform is rotated until the desired stored item is located and is then returned to its stored position.

The storage unit may have multiple platforms and may be configured in a number of ways depending on the available space, the type of bedframe, and installation considerations. As will be seen below, a bedframe specifically designed for the storage unit of the present invention is also envisioned.

BRIEF DESCRIPTION OF THE DRAWINGS

FIG. 8 shows use of a prior art under bed storage unit;

FIG. 9 shows use of an improved under bed storage unit;

DESCRIPTION OF THE PREFERRED EMBODIMENT

Figure 1:
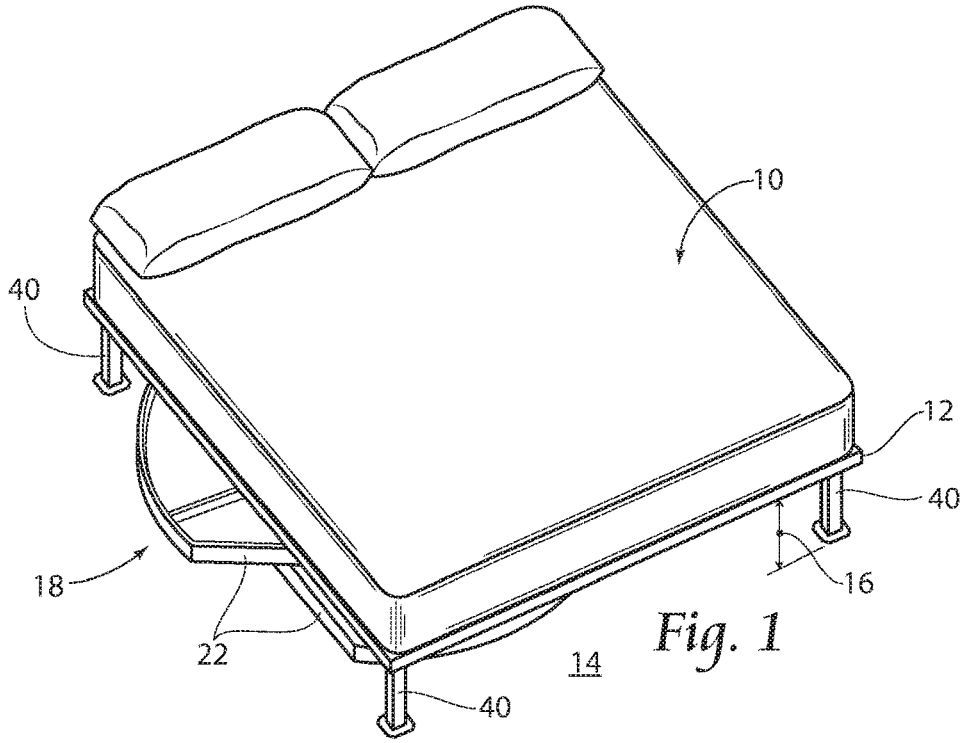
FIG. 1 is a perspective view of a first embodiment of the storage unit of the present invention in place beneath a bed and bed.
Figure 2:
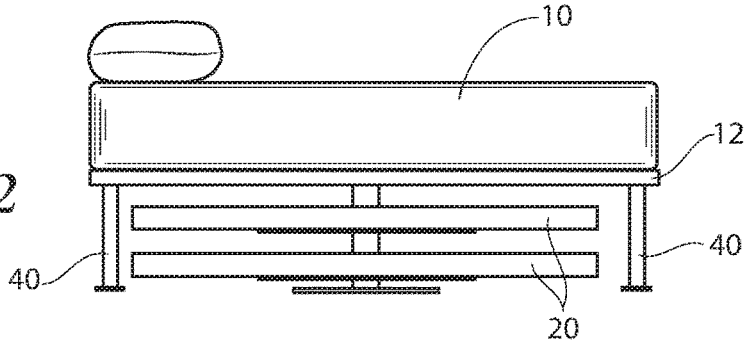
FIG. 2 is a side view of the embodiment shown in FIG. 1.
Figure 3:
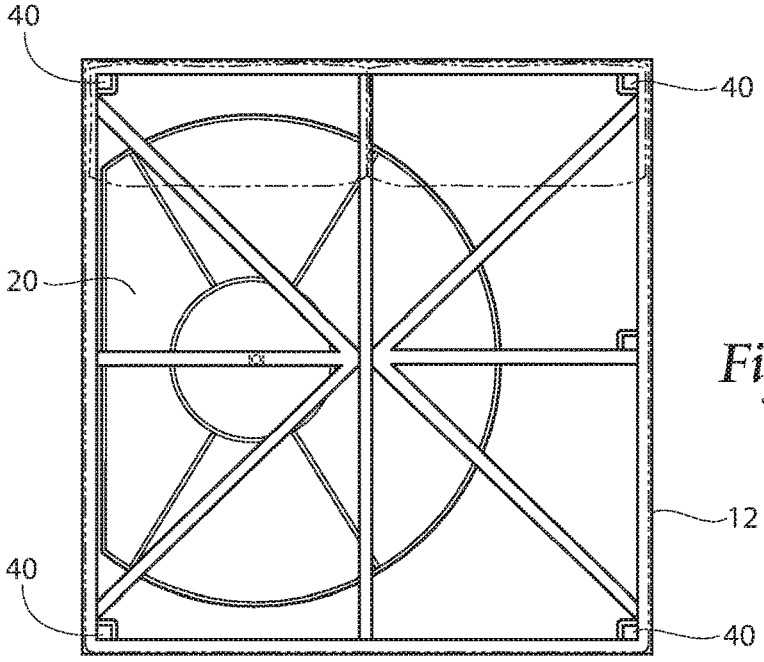
FIG. 3 is a top view of the embodiment shown in FIG. 1 minus the mattress.
Figure 4:
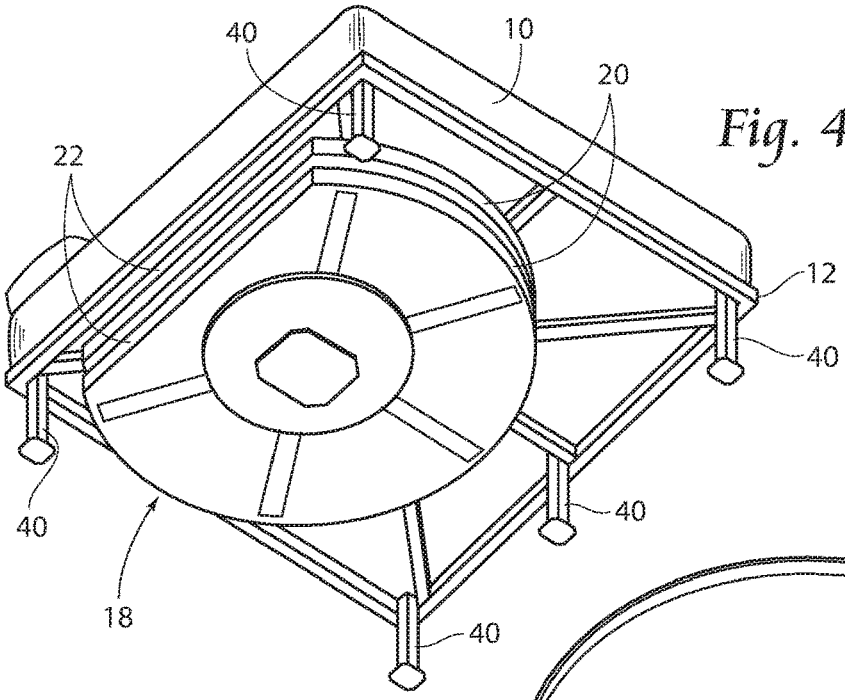
FIG. 4 is a bottom perspective view of the embodiment shown in FIG. 1.

FIGS. 1-4 are illustrations of a bed 10 having a bed frame 12 that raises bed 10 off of the floor 14, leaving a gap 16 between bed 10 and floor 14. An under-bed storage unit 18 comprising at least one rotatable platform 20 can be installed within gap 16 to store items such as shoes, clothes, bed linens, books, or other items (see FIG. 7).

As noted, unit 18 comprises at least one rotatable platform 20 but in another embodiment, two or more platforms 20 are provided. The number of platforms 20 provided will depend on the user's preference, keeping practical considerations such as the size of gap 16, the size of the items to be stored, etc. in mind.

Platforms 20 may have a circular segment removed therefrom, forming an edge 22. Such a generally "D" shaped profile permits protrusion of platforms 20 and access of items upon rotation. In a storage position, however, edges 22 of platforms 20 would not extend past the margin of bedframe 12.

Figure 5:
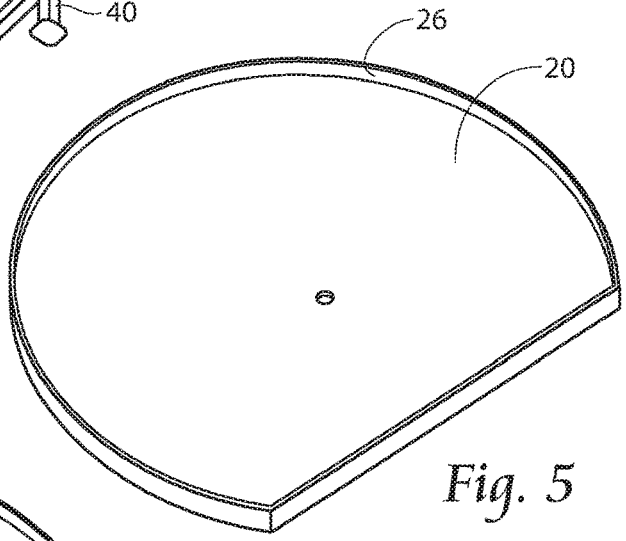
FIG. 5 is a top perspective view of a platform of a second embodiment of the present invention.
Figure 7:
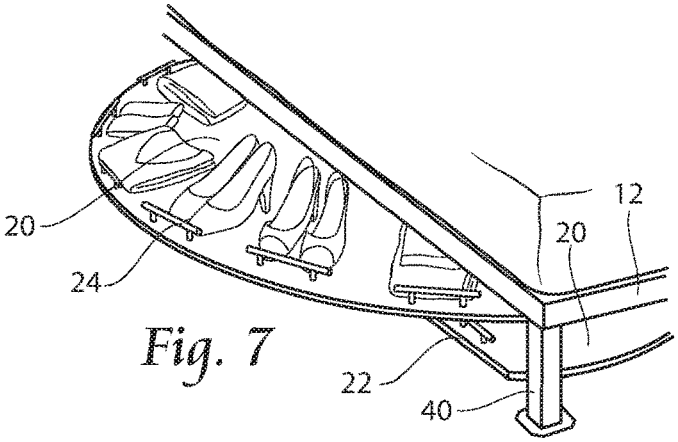
FIG. 7 is a perspective view of another embodiment of the present invention in use.

As seen in FIG. 7, platform 20 may be provided with a plurality of bumpers or stops 24. Other embodiments such as handles or the like are also within the scope of the present invention. These prevent items on platform 20 from slipping off during rotation and/or provide the user with a grip for easier rotation. This function could also be performed by provision of a lip 26 surrounding the perimeter of platform 20, as seen in FIG. 5.

Figure 6:
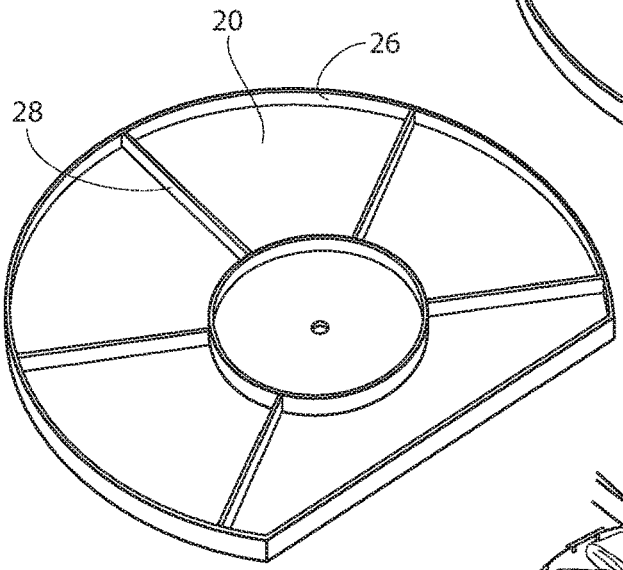
FIG. 6 is a top perspective view of a platform of a third embodiment of the present invention.

In another embodiment shown in FIG. 6, in addition to lip 26 at the perimeter of platform 20, dividers 28 may be provided on platform 20 to prevent stored items from being mixed up during rotation of platform 20.

Figure 18:
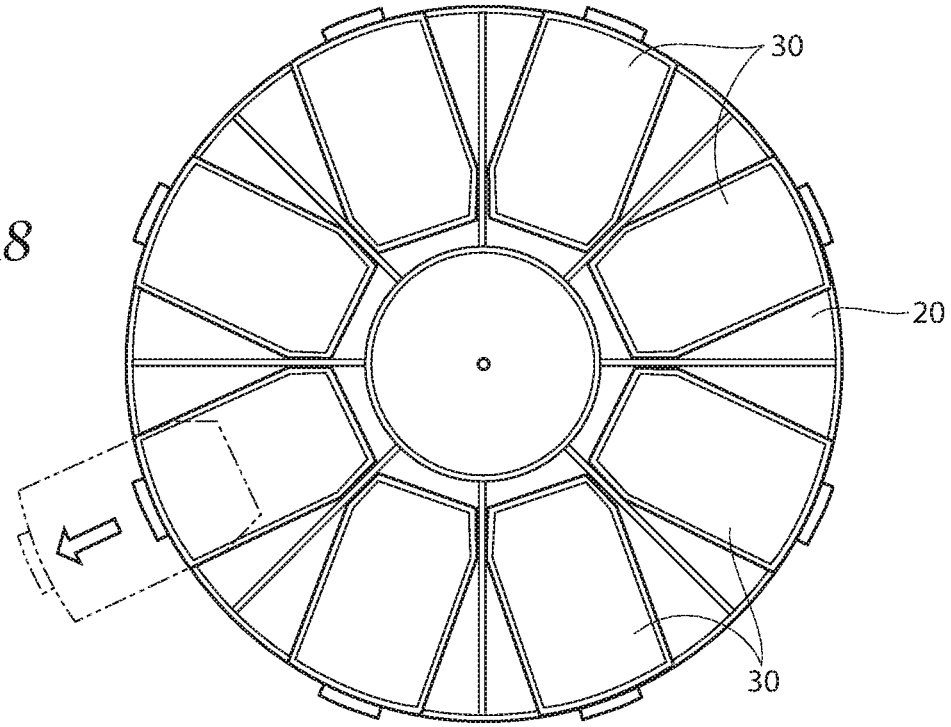
FIG. 18 is a top view of another embodiment of the present invention.

Note that lip 26 and/or dividers 28 may be provided in various heights to provide a shallow storage ledge or deeper storage bins. Alternately, one or more external drawers 30 could be provided on platform 20 as shown in FIG. 18. Again, the user's preference, in light of practical considerations, will drive the choice of configurations.

One of the benefits of the preferred embodiment of the invention is shown in FIGS. 8 and 9. In FIG. 8, it can be seen that traditional under-bed drawers are impeded from full opening by adjacent furniture. However, as seen in FIG. 9, storage unit 18 accommodates the limited space easily.

Each individual platform 20 may be provided with a gripping apparatus such as a finger pull or grip to urge platform 20 out of its stored position and returning it to its stored position after accessing the items within. A stop mechanism 34 may be provided such that at least some force may be required to overcome the unit's resting, i.e., stored position. Further, stop mechanism 34 will allow platform 20 to readily return to its stored position without the user having to manually adjust alignment of edge 22 with the margin of bedframe 12. Stop mechanism 34 can take any number of forms, including clips, magnets, or other suitable apparatus.

Figure 10:
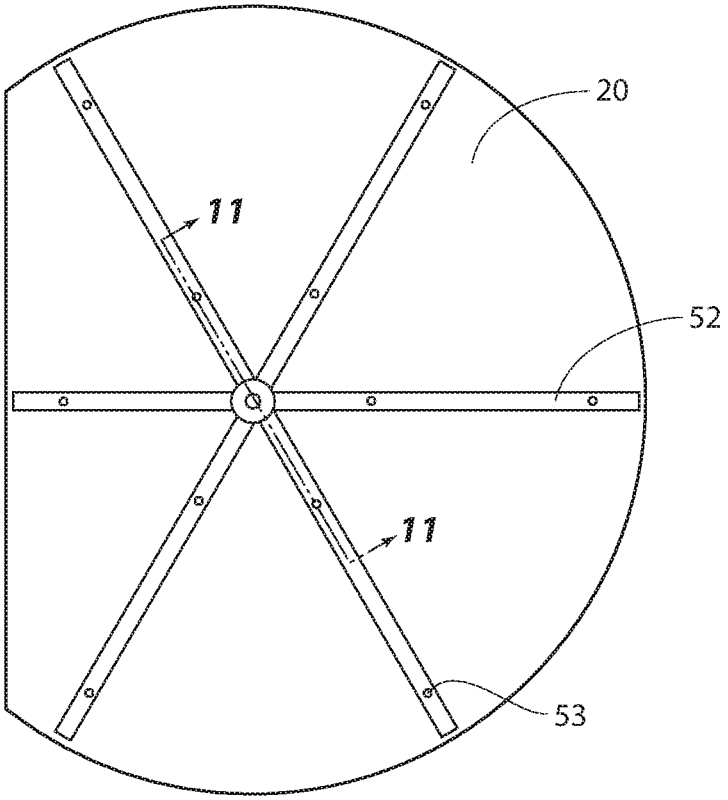
FIG. 10 is a bottom view of a freestanding support structure.
Figure 11:
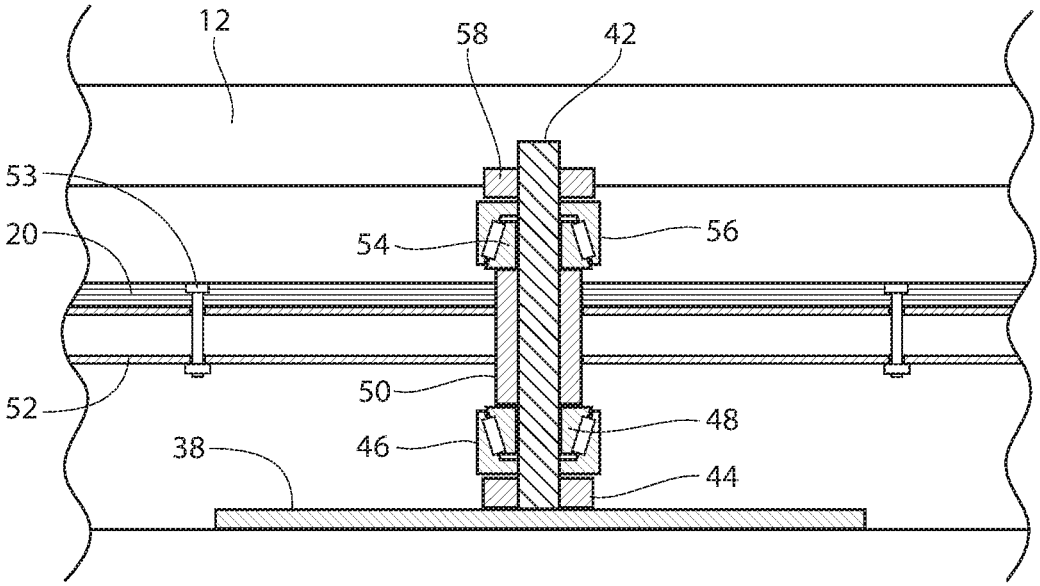
FIG. 11 is a side cutaway view taken from line 11-11 of FIG. 10.
Figure 12:
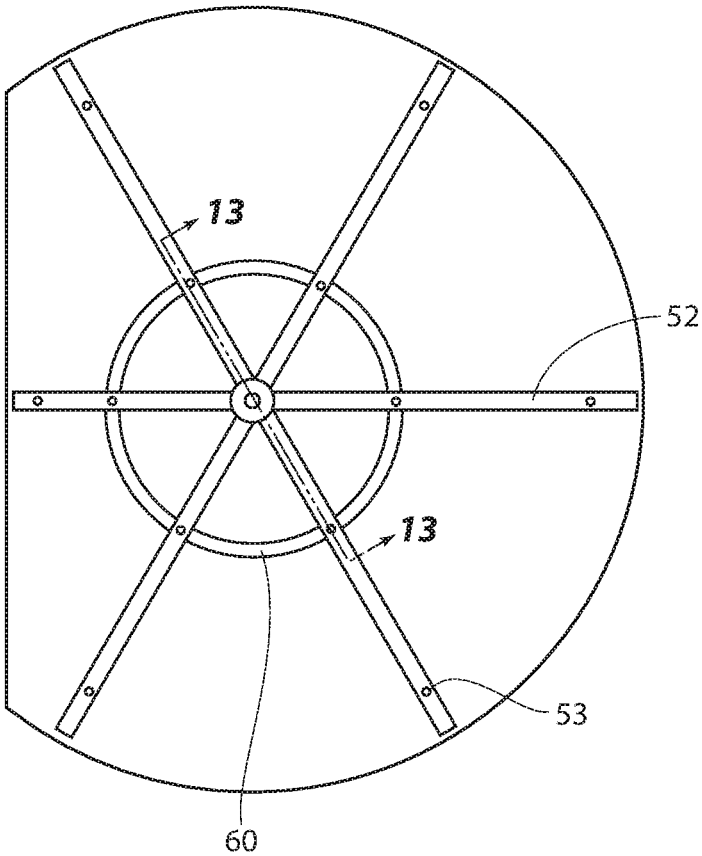
FIG. 12 is a bottom view of a circular bearing support structure.

In the embodiments shown in FIGS. 10 and 11, storage unit 18 is carried by a freestanding support structure 36. It can be seen that structure 36 has base portion 38 that is large and sturdy enough to support a large diameter platform 20 that may carry a heavy or unbalanced load.

Figure 13:
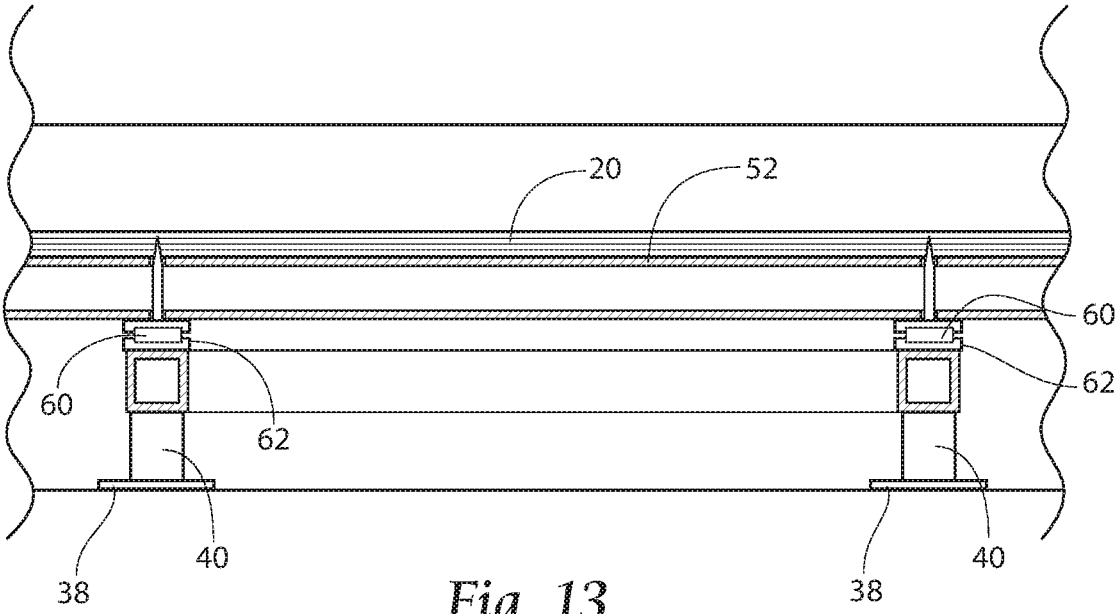
FIG. 13 is a side cutaway view taken from line 13-13 of FIG. 12.

As best seen in FIG. 11, base 38 is provided for placement on the floor under a bed. However, as seen in FIG. 13, unit 18 may also be placed on floor 14 indirectly by a way of legs 40 connected to base 38 in the event that placement of the base on floor 14 is undesirable. This could be the case with delicate tile, valuable carpeting, or other surfaces that may mar unacceptably.

Returning now to FIG. 11, base portion 38 bears a shaft 42 having a spacer 44 mounted thereon. Shaft 42 also carries a lower bearing 46, a lower bearing race 48, a center support mount 50 having a center support 52, an upper bearing race 54, an upper bearing 56, and a clamp 58. Center support is attached to platform 20 by way of connectors 53. In the event of multiple platforms 20, these parts would be multiplied and adjusted accordingly.

FIGS. 20-22 and FIG. 30 illustrate potential alternate mounting structures.

In another embodiment, different or secondary support structures are provided in the form of a circular bearing 60. A more traditional (though raised and freestanding) support structure 36 can be seated on track 62 under and interiorly of the margins of platform 20.

Storage unit 18 can also be configured to have the appearance of an under-bed storage drawer such as can traditionally be seen in some platform beds. This can be accomplished in a number of ways. For instance, as seen in FIGS. 16, 17, 28, and 29, a faux drawer front 64 can be added to edge 22 of platform 20. Alternately, a true drawer 66 large enough to accommodate one or more platforms 20 could be provided.

Figure 27:
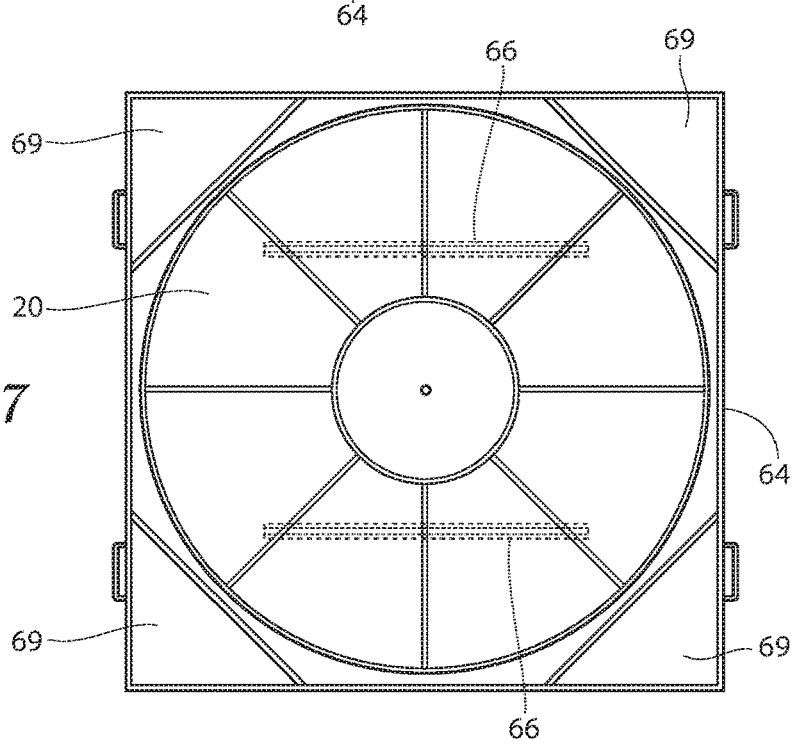
FIG. 27 is a top view of another embodiment of a platform and drawer such as shown in FIG. 23.
Figure 28:
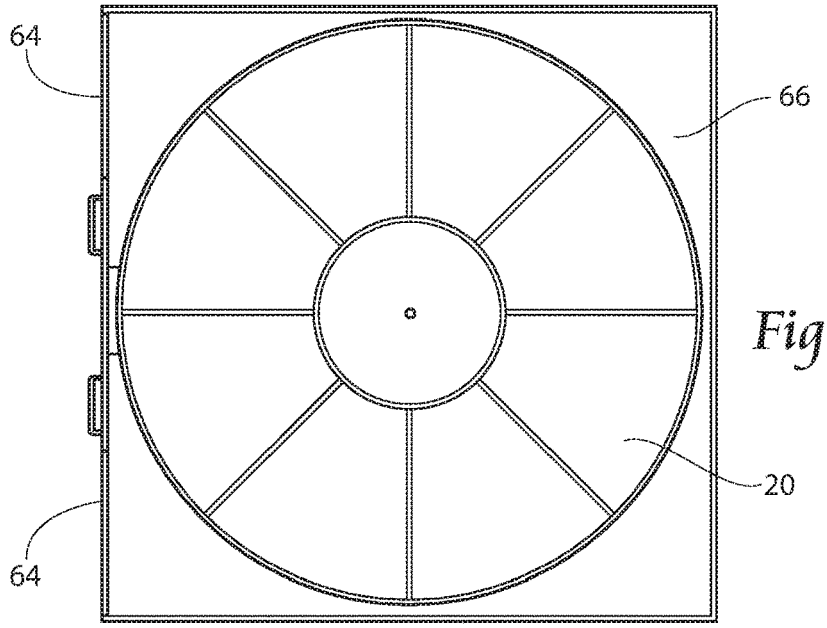
FIG. 28 is a top view of another embodiment of the storage unit of the present invention.
Figure 29:
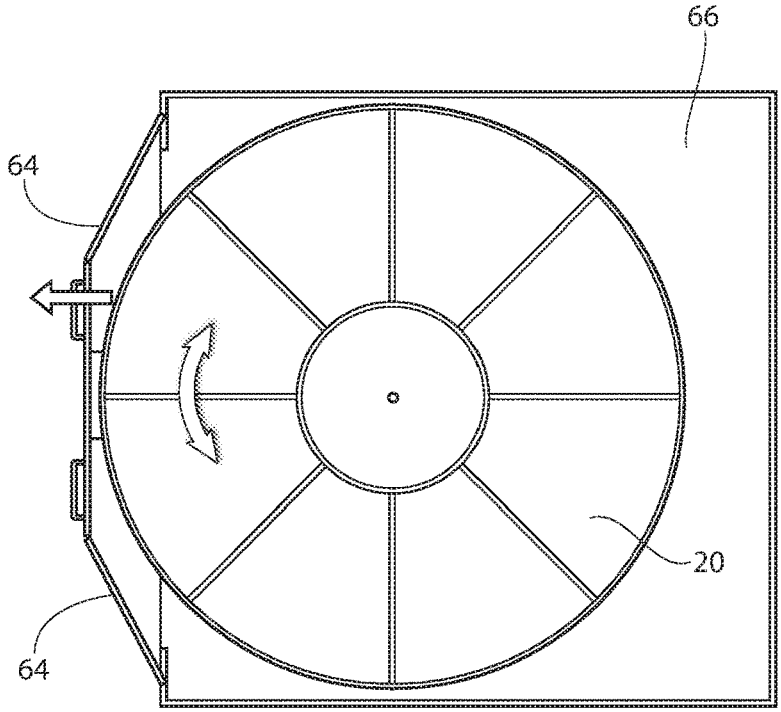
FIG. 29 shows the embodiment of FIG. 28 in use.
Figure 30:
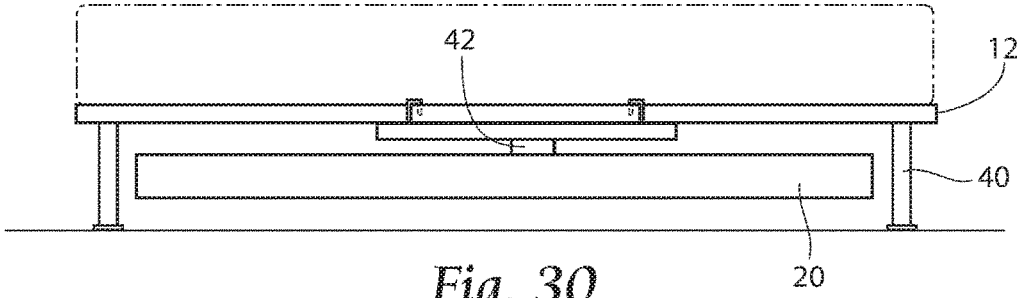
FIG. 30 is a side view another embodiment of the storage unit of the present invention.

In the event of a true drawer 66, a sliding mechanism 68 would be provided to allow drawer 66 to be slideably pulled from under bed 10. Sliding mechanism 68 could include rails, wheels, reduced friction surfaces, or other means. As seen in FIG. 27, to maximize storage capacity, drawer 66 may also be provided with storage areas 69 that surround platform 20. A platform 20 provided within a drawer 66 might not require all elements of support structure 36 since it would rest on the bottom of drawer 60.

Figure 19:
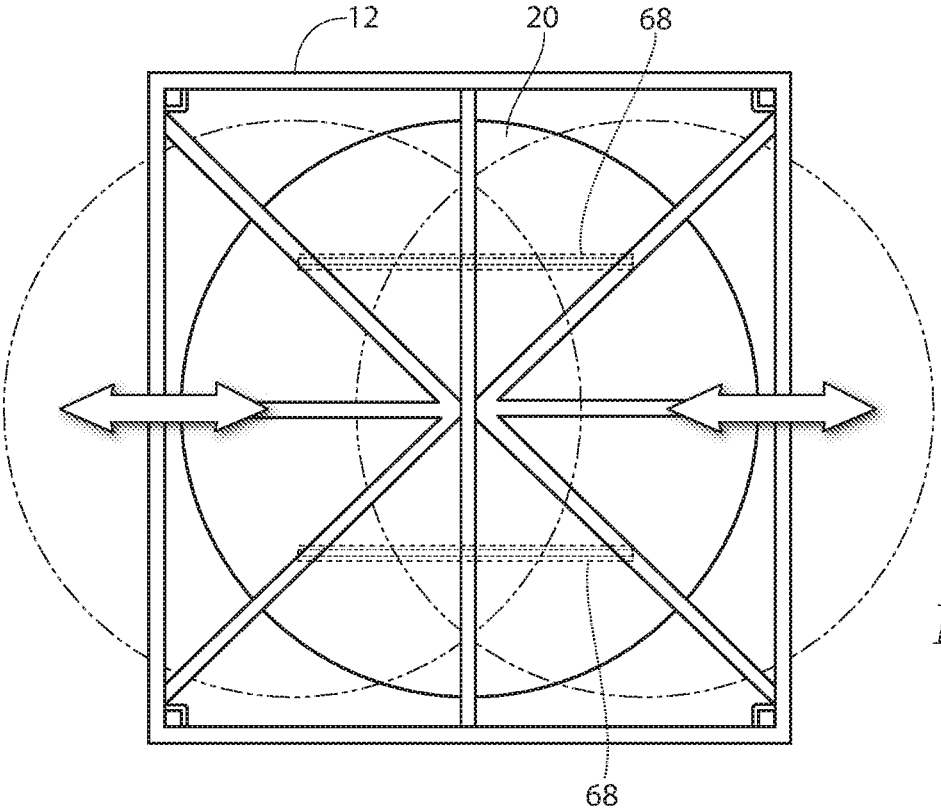
FIG. 19 is a top view of another embodiment of the present invention.
Figure 20:
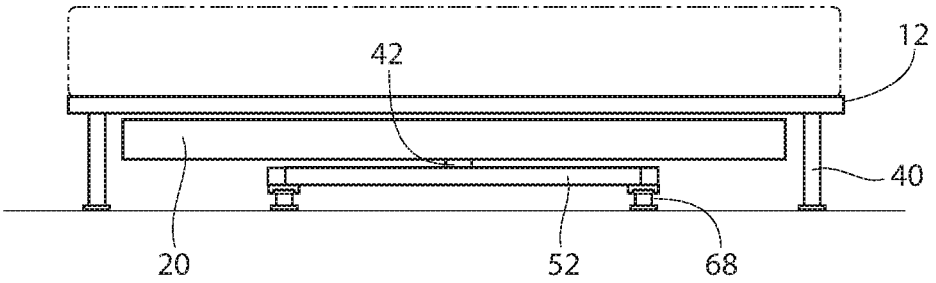
FIG. 20 is a side view of another embodiment of the present invention.
Figure 21:
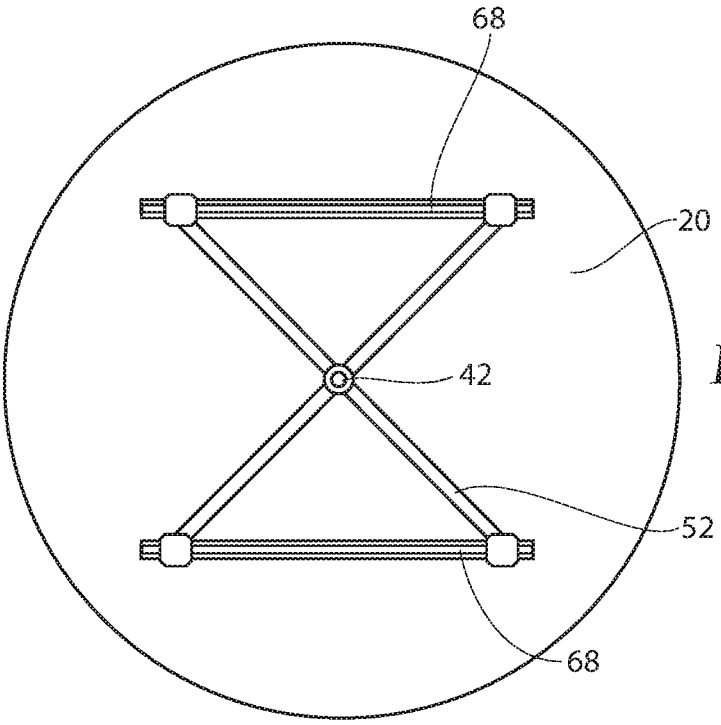
FIG. 21 is a bottom view of the embodiment shown in FIG. 20.
Figure 22:
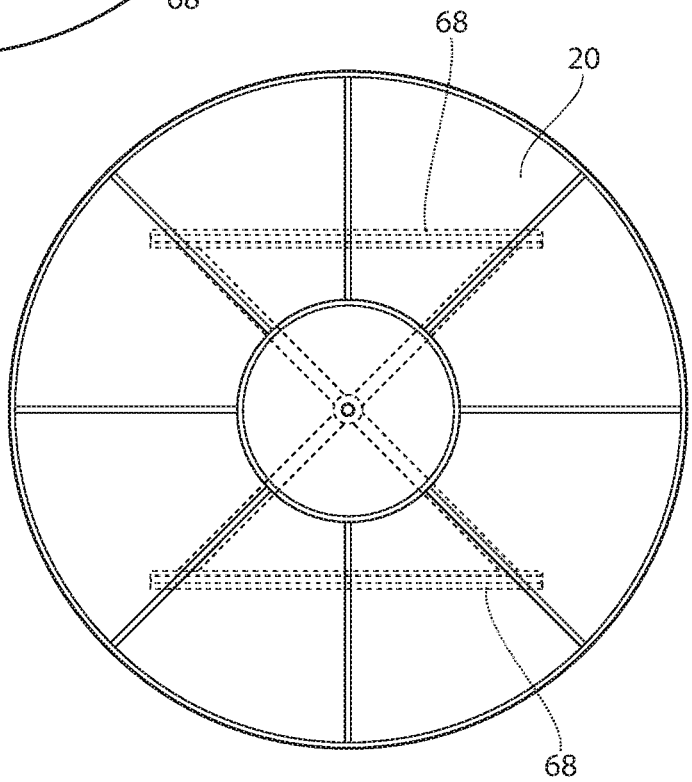
FIG. 22 is a top view of the embodiment shown in FIG. 20.
Figure 23:
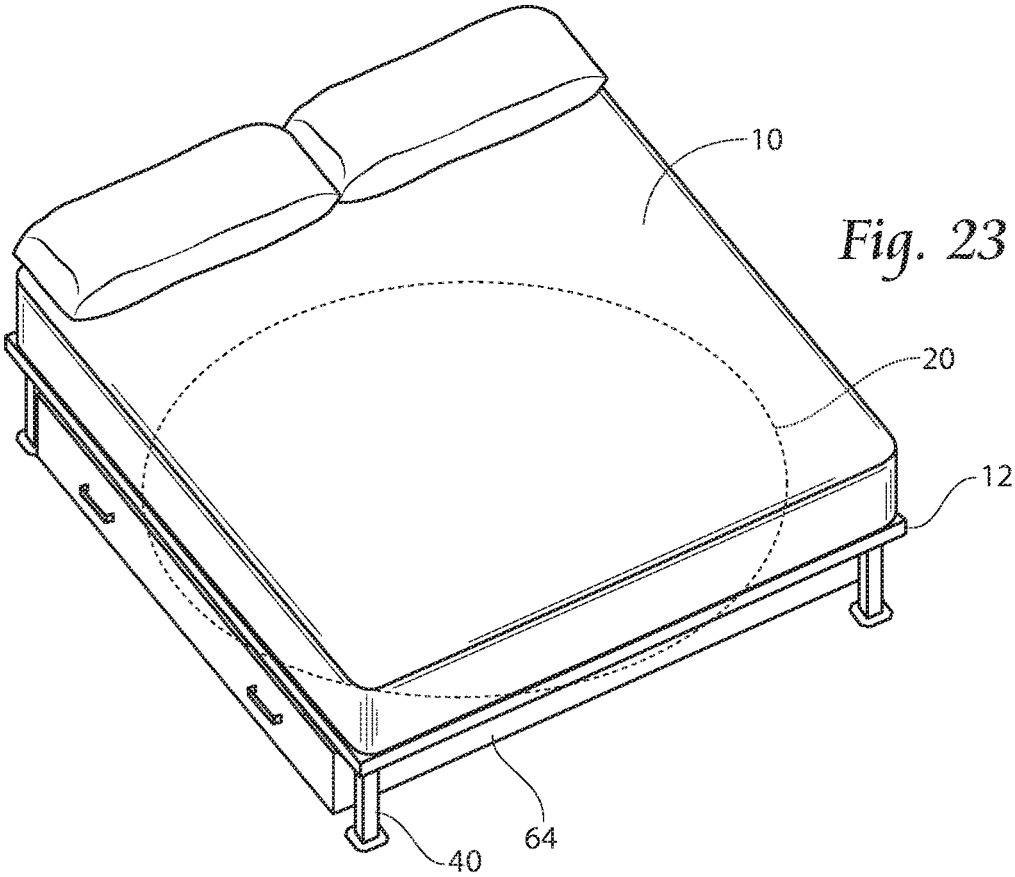
FIG. 23 is a top perspective view of a platform of another embodiment of the present invention.
Figure 24:
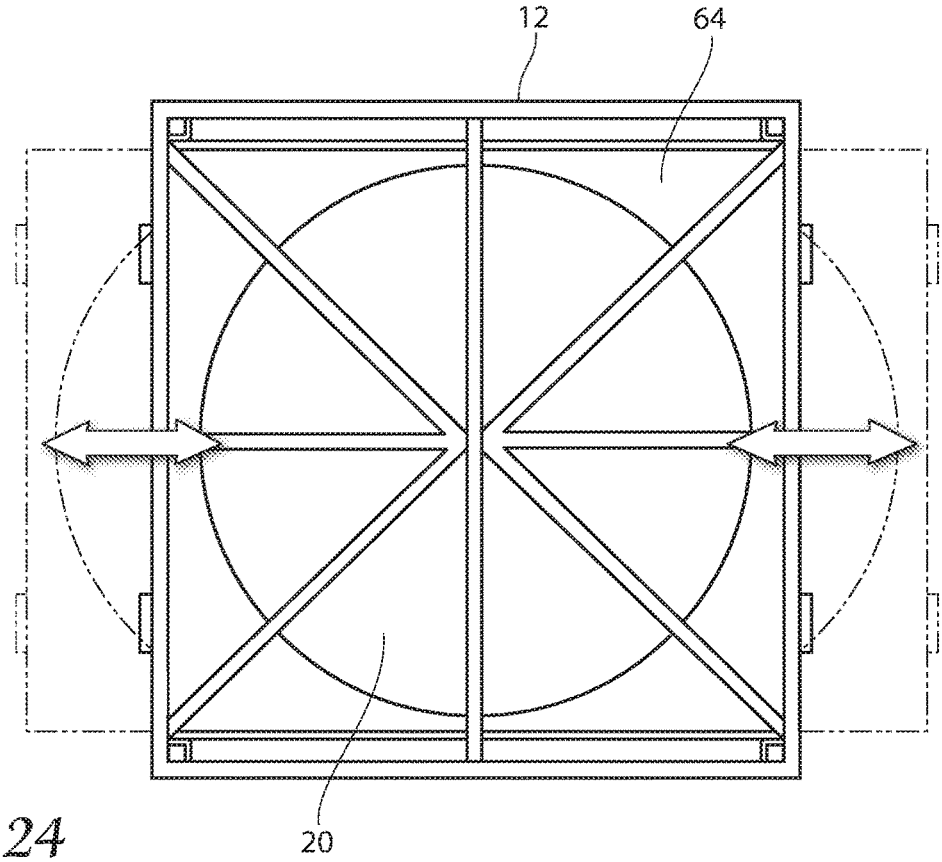
FIG. 24 is a top view of the embodiment shown in FIG. 23.
Figure 25:
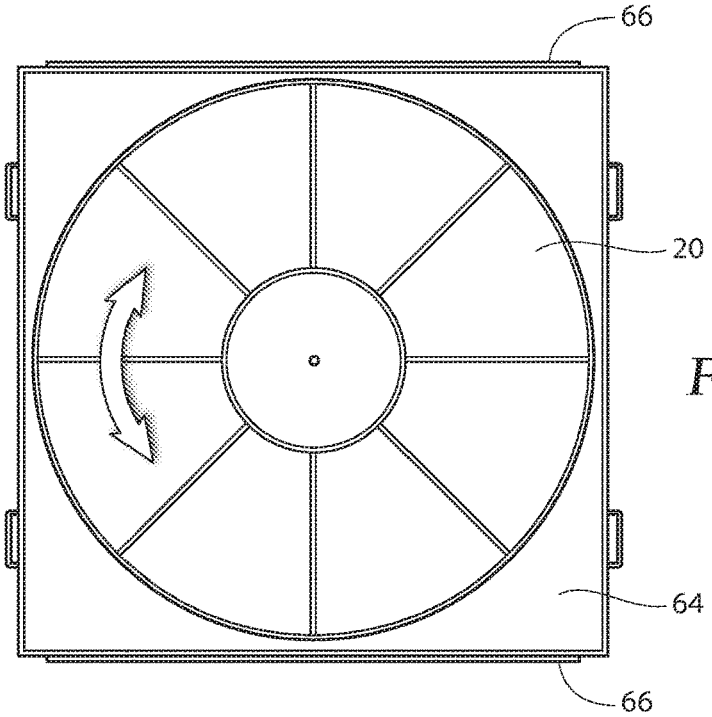
FIG. 25 is a top view of the platform and drawer shown in FIG. 23.
Figure 26:
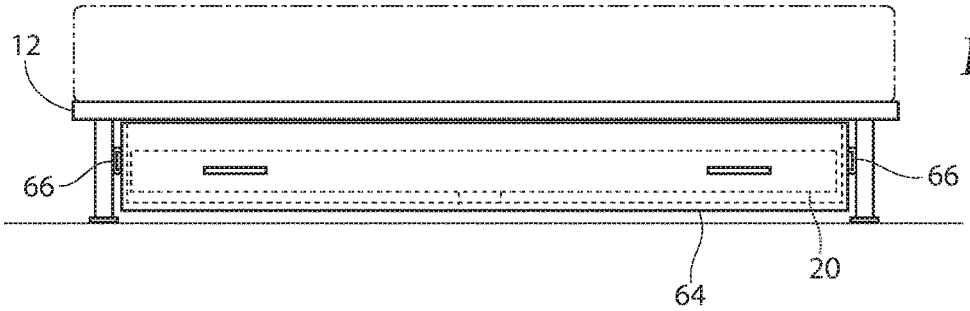
FIG. 26 is a side view of the platform and drawer shown in FIG. 23.

Sliding mechanisms 68 could also be used without drawer 66, such as is shown in FIG. 19. In this way it would be possible for platform 20 to be accessed from either side of bed 10 either with or without the provision of edge 22. Storage unit 18 could also be mounted to the bottom of the bedframe, either through use of a support structure similar to structure 36 or a sliding mechanism similar to mechanism 68.

Figure 31:
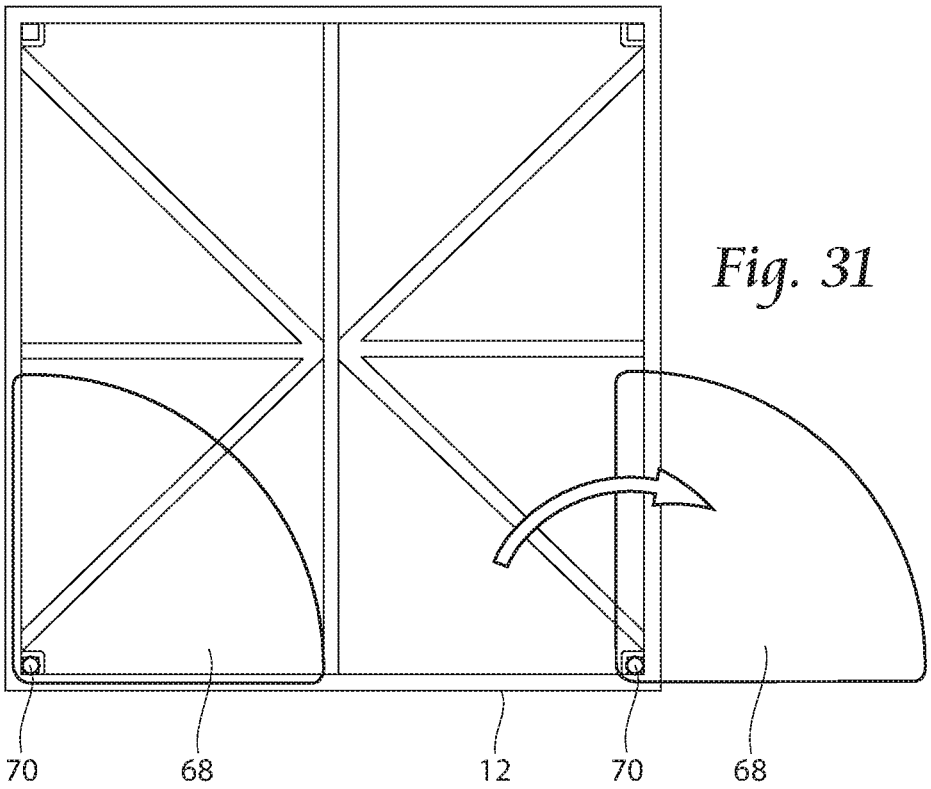
FIG. 31 is a top view of yet another embodiment of the present invention.
Figure 32:
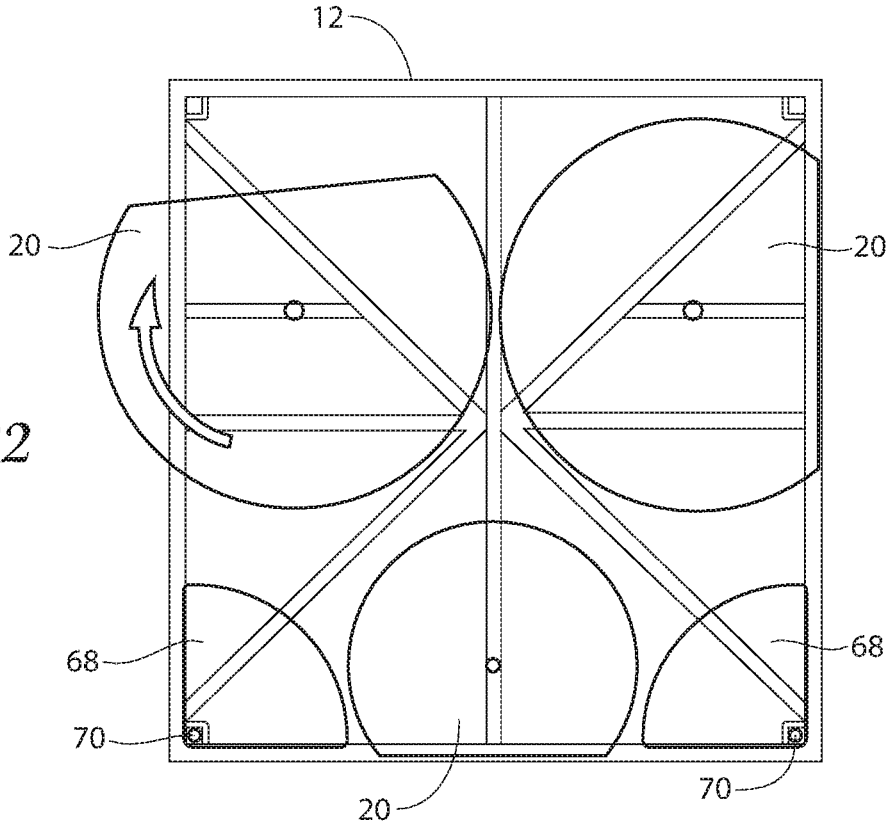
FIG. 32 shows a top view of an embodiment in which multiple storage units are combined.

The invention is configurable to work with most pre-existing bedframes, including, as seen in FIGS. 31 and 32, those with central support standards (not shown). For example, a 90° platform segment 70 could be provided with an axial shaft 72 located at the corner of the bedframe. Likewise, a variety of different sized platforms 20 could be arranged under a bed, along with a plurality of 90° segments if desired, to customize the storage unit of the present invention to different user needs.

Figure 14:
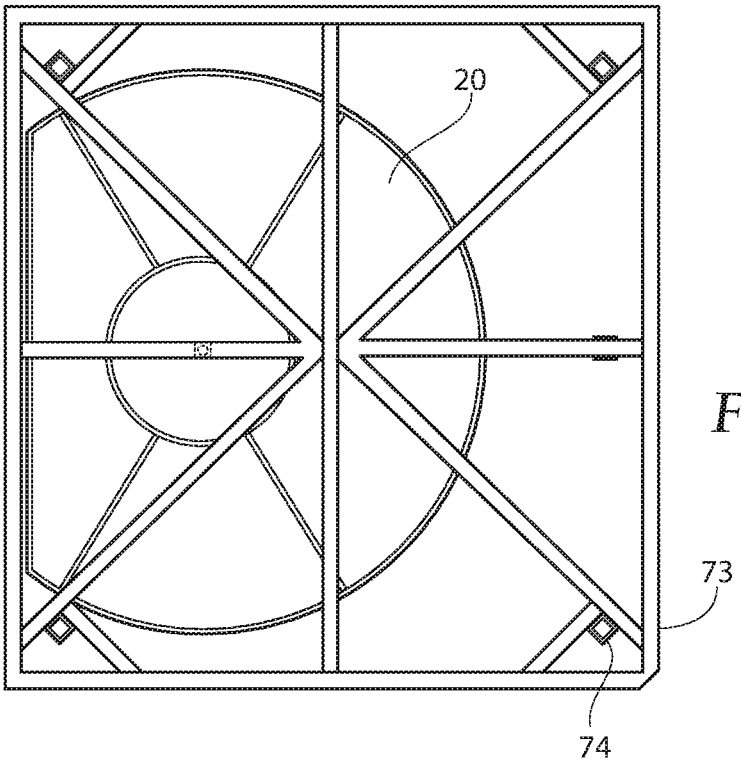
FIG. 14 is a top view of a bed frame of the present invention.
Figure 15:
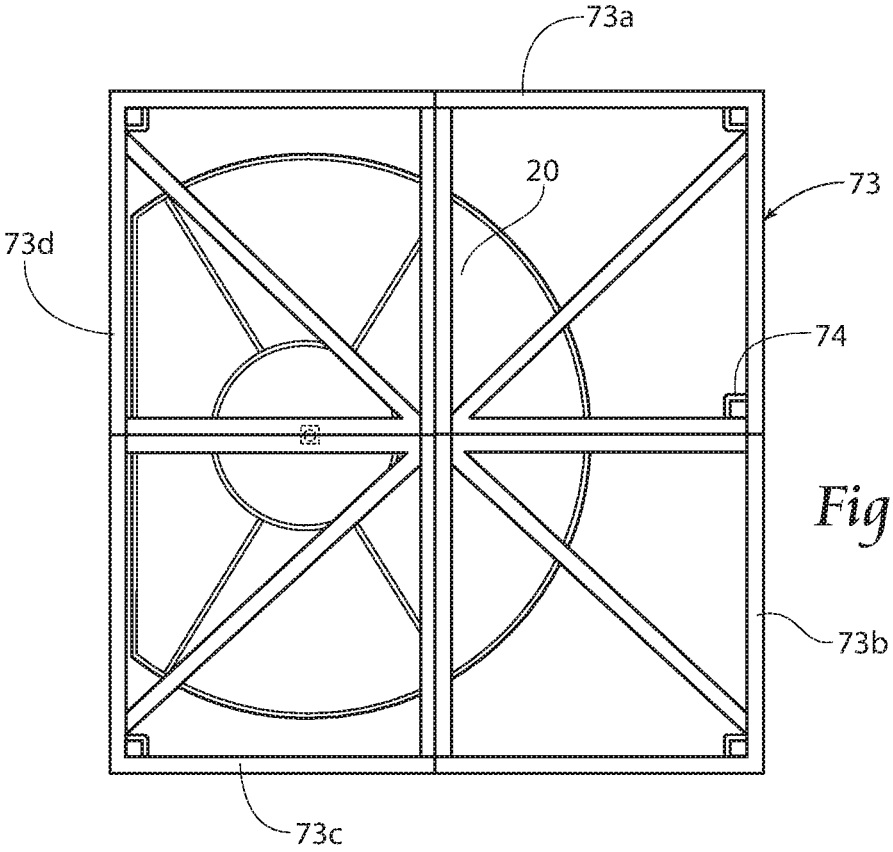
FIG. 15 is a top view of a bed frame of the present invention in which the bed frame is divided into multiple parts.
Figure 16:
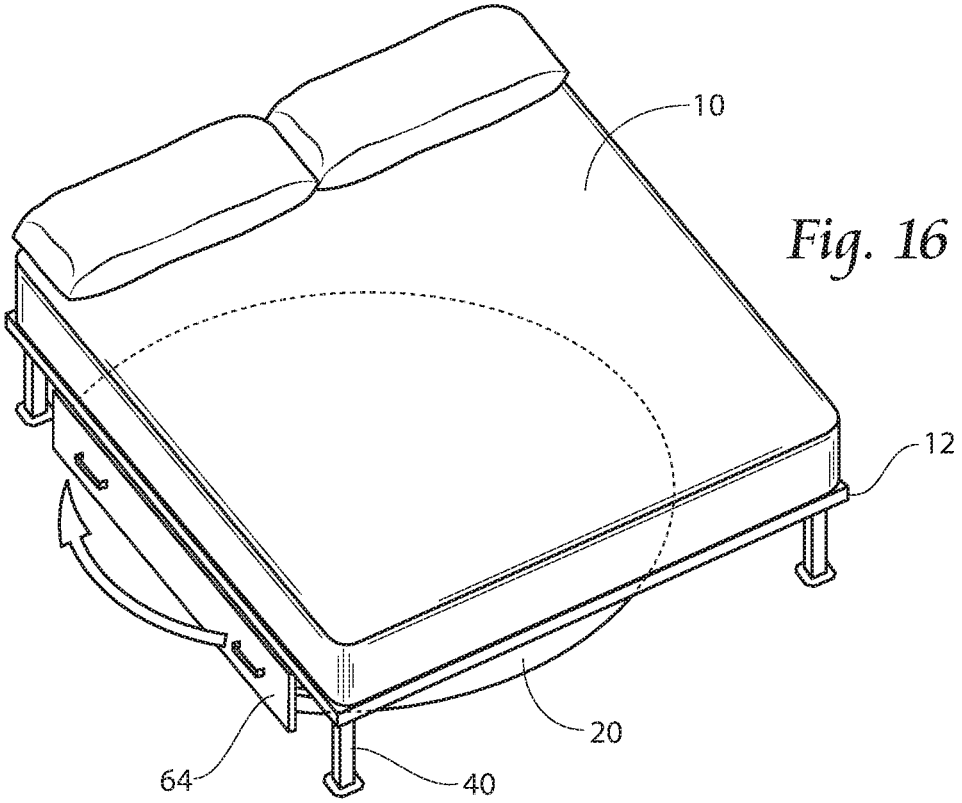
FIG. 16 is a top perspective view of another embodiment of the present invention.
Figure 17:
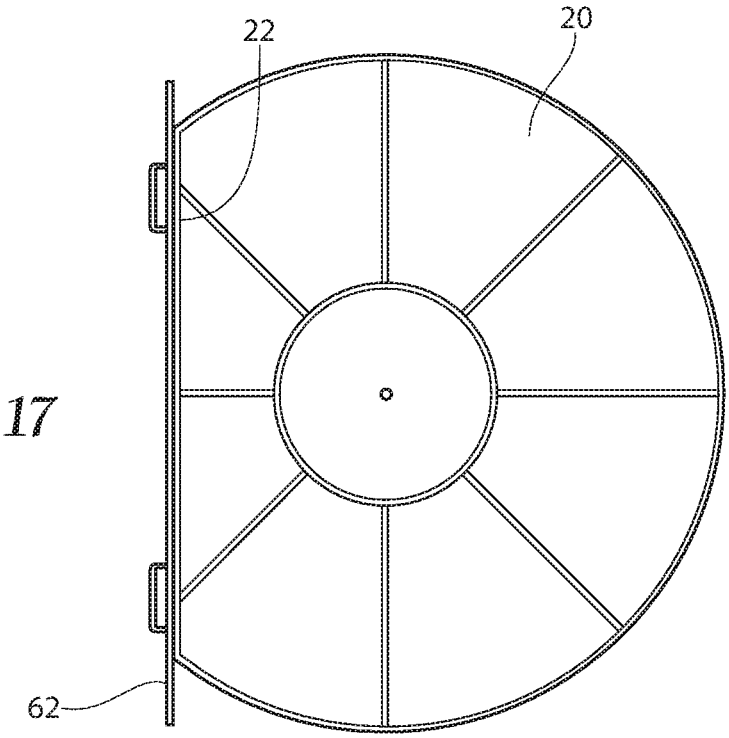
FIG. 17 is a top view of the platforms shown in FIG. 16.

However, a bedframe 73 specifically suited to accommodating an embodiment of storage unit 18 is also envisioned. The device-specific frame 73 may be constructed as a single unit of welded beams, or, in a more likely scenario, as seen in FIG. 19, frame 73 is constructed in multiple parts. For instance, the embodiment shown in FIG. 19 is constructed of four parts (73*a*, 73*b*, 73*c*, 73*d*) that are bolted together on site. The legs 76 may be provided pre-welded or separately. FIG. 14 shows a variant of FIG. 19 in which legs 74 are located inwardly of the margins of bedframe 73. This configuration may be useful where greater distribution of support is required, such as in bariatric applications.

The multiple part embodiment of bed frame 73 is also advantageous because it permits the frame to be palletized or boxed for shipping. Further, unit 18 does not require welding and can be readily moved through doorframes.

The diameter of platform 20 may require center supports 52 to extend substantially the entire radius of platform 20. This is particularly true if the platform is constructed of lightweight material, in order to prevent instability during rotation and at rest. However, radii of 50% or even smaller diameters may be used in certain situations, such as when cost reduction is an issue or only storage of lightweight items is contemplated.

In another embodiment of the present invention shown in FIGS. 33-39, platform 20 of under-bed storage unit 18 is provided with an auxiliary platform 76 that allows access to any potentially unused storage space toward the center of primary platform 20.

Auxiliary platform 76 is generally U-shaped with a flat end 78 coextensive with flat end (edge) 22 of platform 20. Auxiliary platform 76 is designed to be deployed when platform 20 is in its stored position.

Figure 33:
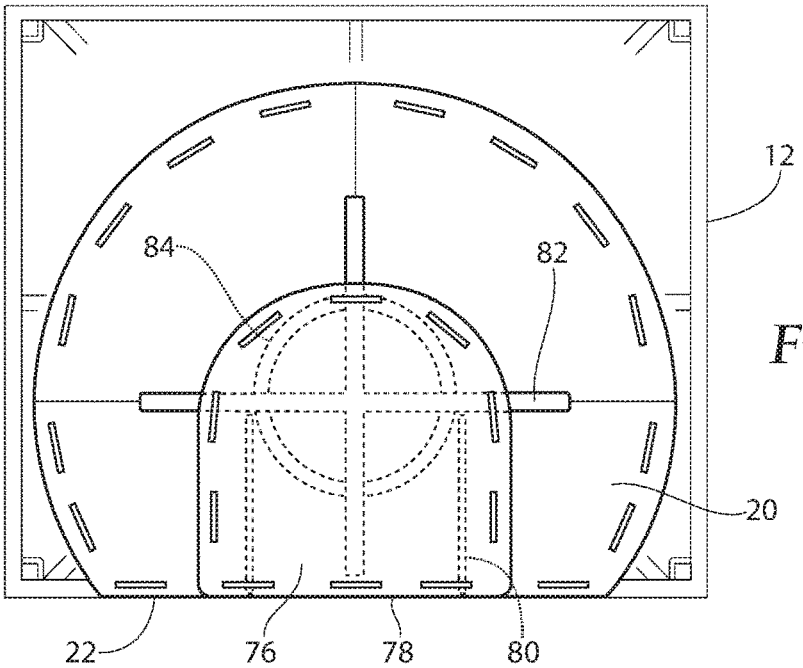
FIG. 33 is a top view of a dual platform embodiment of the present invention.
Figure 34:
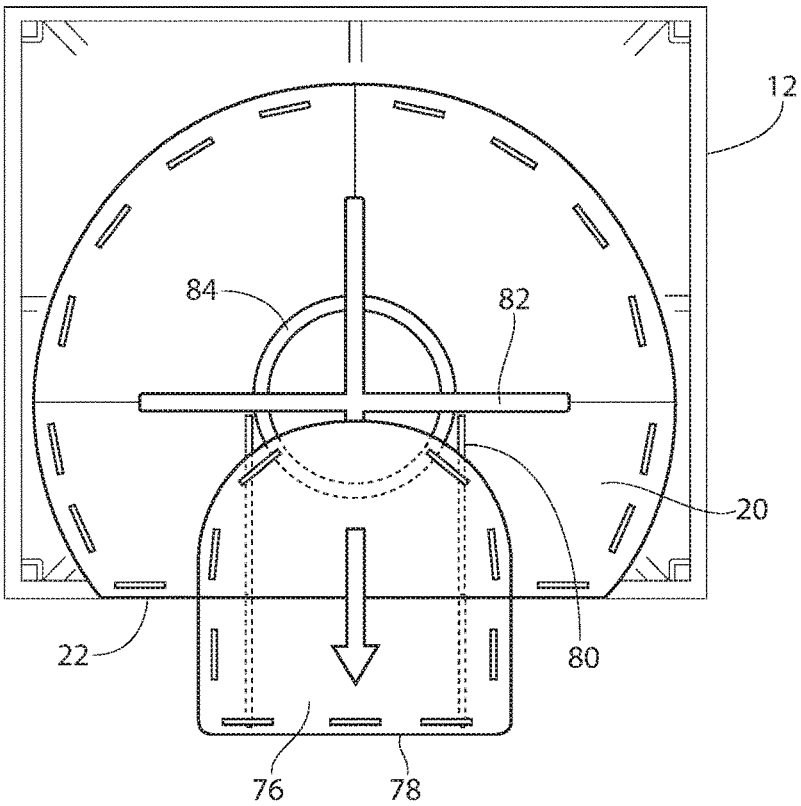
FIG. 34 is a view of FIG. 33 showing the device in use.
Figure 35:
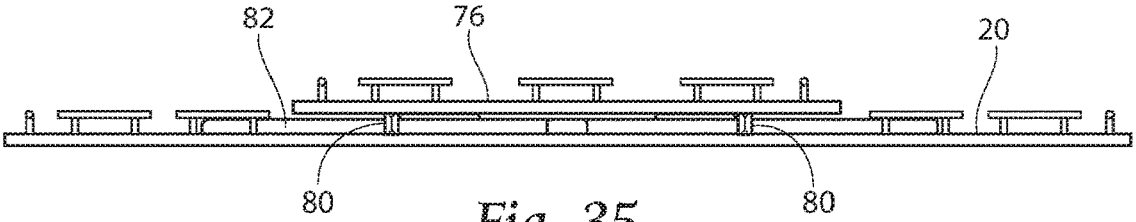
FIG. 35 is a side view of FIG. 33.
Figure 36:
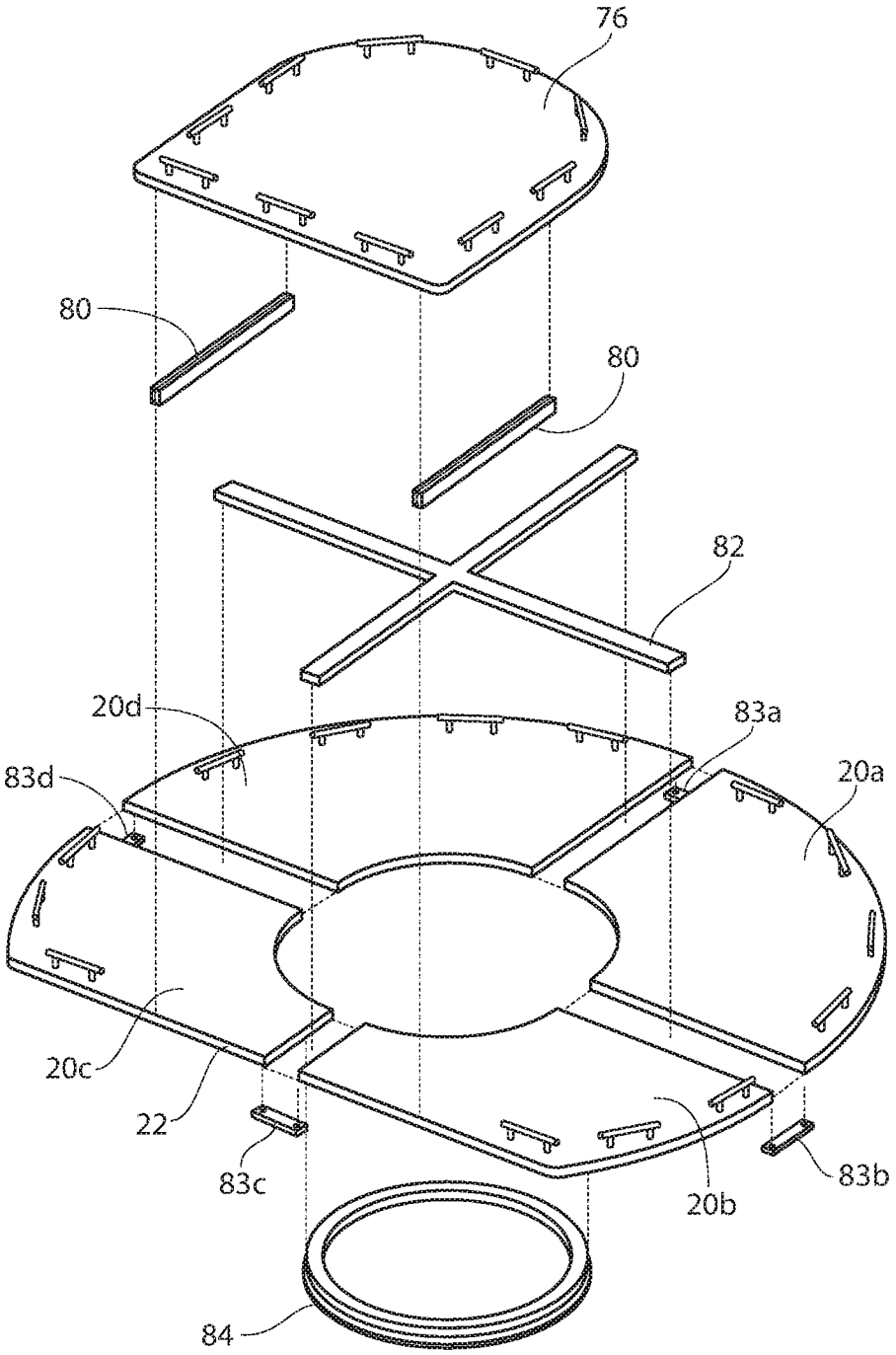
FIG. 36 is an exploded view of FIG. 33.
Figure 37:
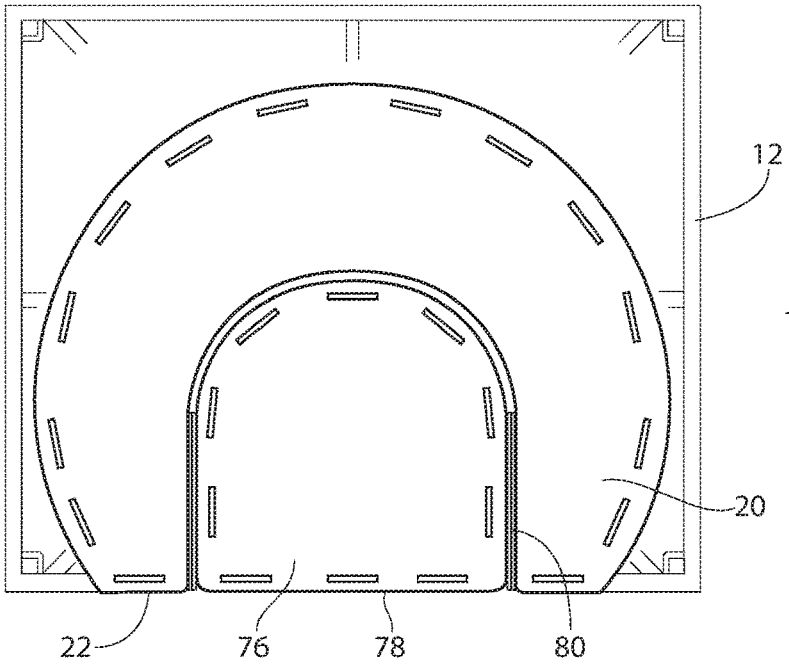
FIG. 37 is a top view of another embodiment of the present invention.
Figure 38:
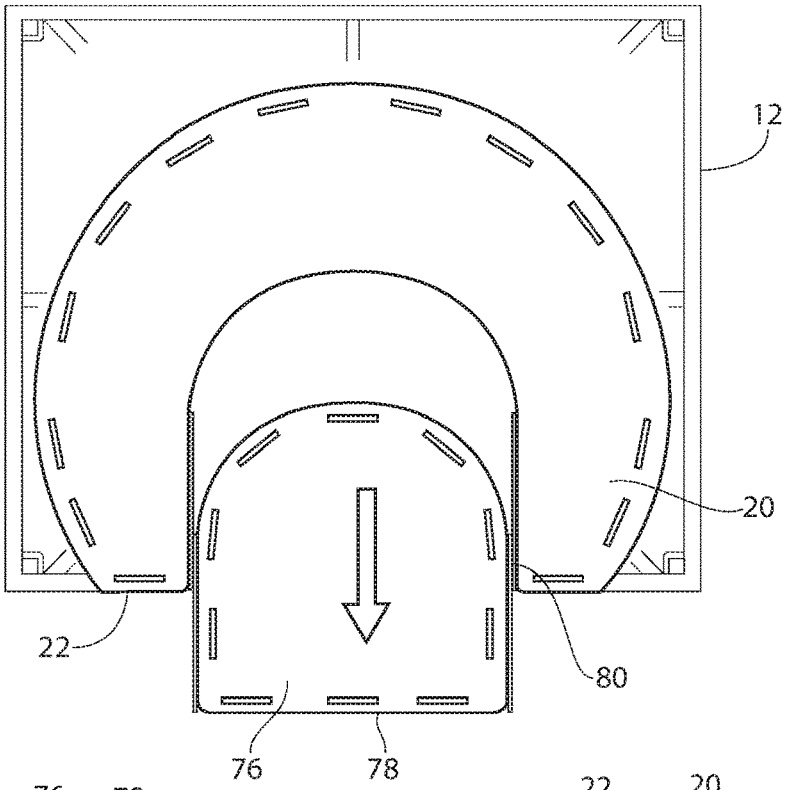
FIG. 38 is a view of FIG. 37 in use.
Figure 39:
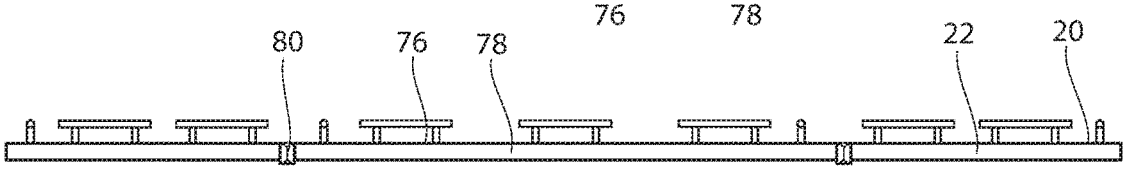
FIG. 39 is a side view of FIG. 37.

U-shaped platform 76 can be provided in-line with platform 20 on side rails 80 or the like, or may be positioned on top of platform 20 with rails 80 beneath. As with device-specific bed frame 73, it may be advantageous for ease of transport to provide platform 20 in two or more parts. As seen in FIGS. 33, 34, and 36, this may be accomplished by providing a platform 20 having four parts, 20*a*, 20*b*, 20*c*, and 20*d*. A connection unit 82 and platform struts 83 are provided for assembling 20*a-d*, and unit 82 can ride on a bearing 84. Alternate embodiments of the primary and auxiliary platforms 20, 78 are possible and should be considered within the scope of the present invention.

Figure 40:
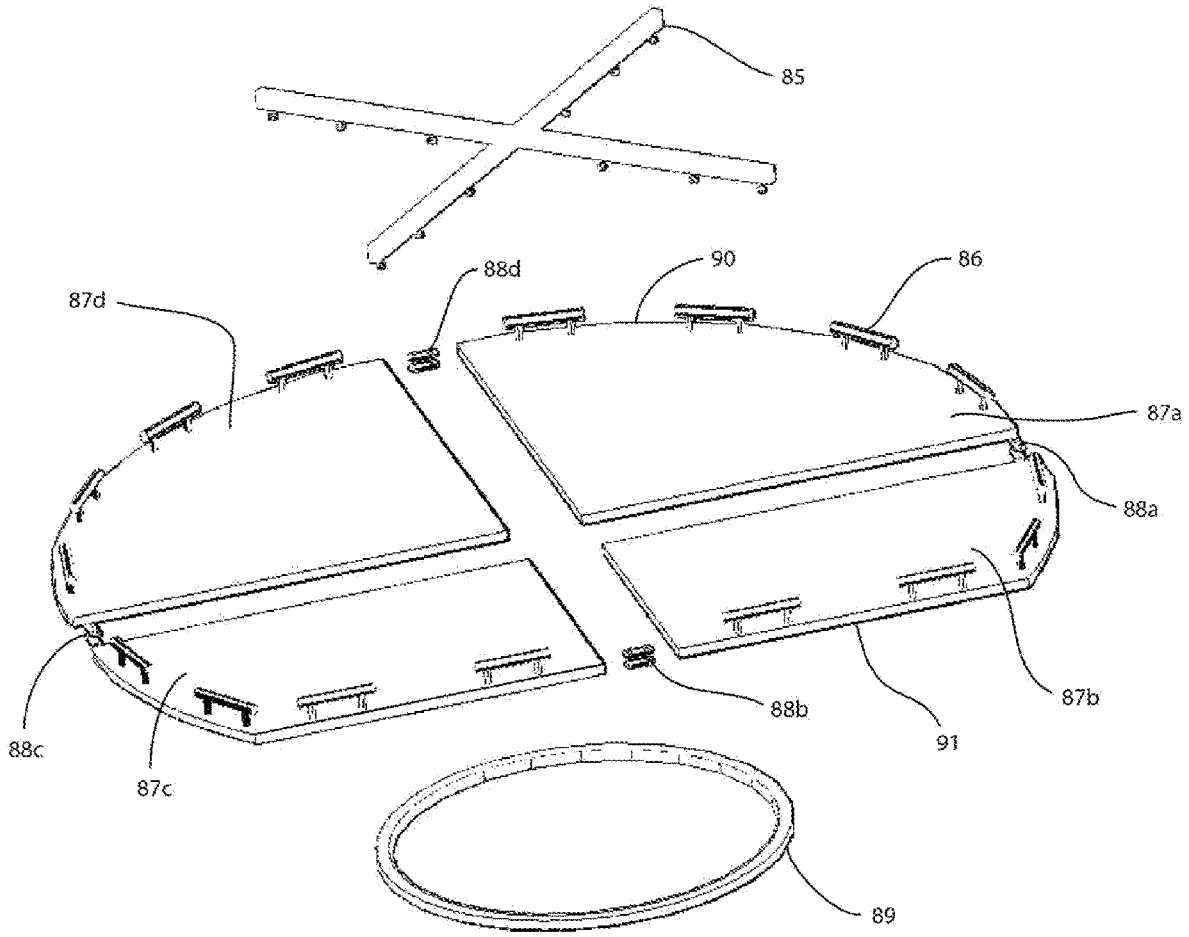
FIG. 40 is an exploded view of a multi piece single platform of another embodiment of the present invention.
Figure 41:
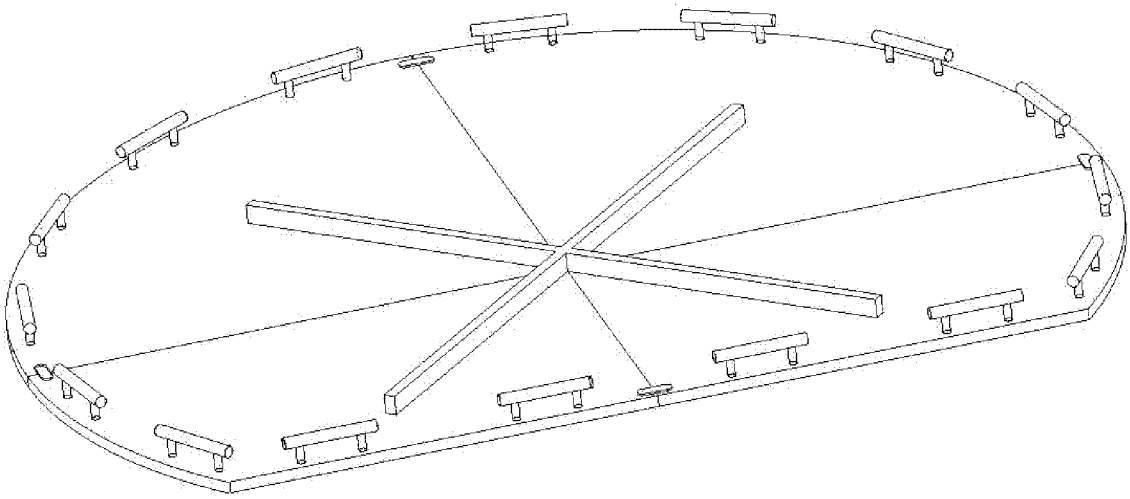
FIG. 41 is a perspective view of FIG. 40.
Figure 42:
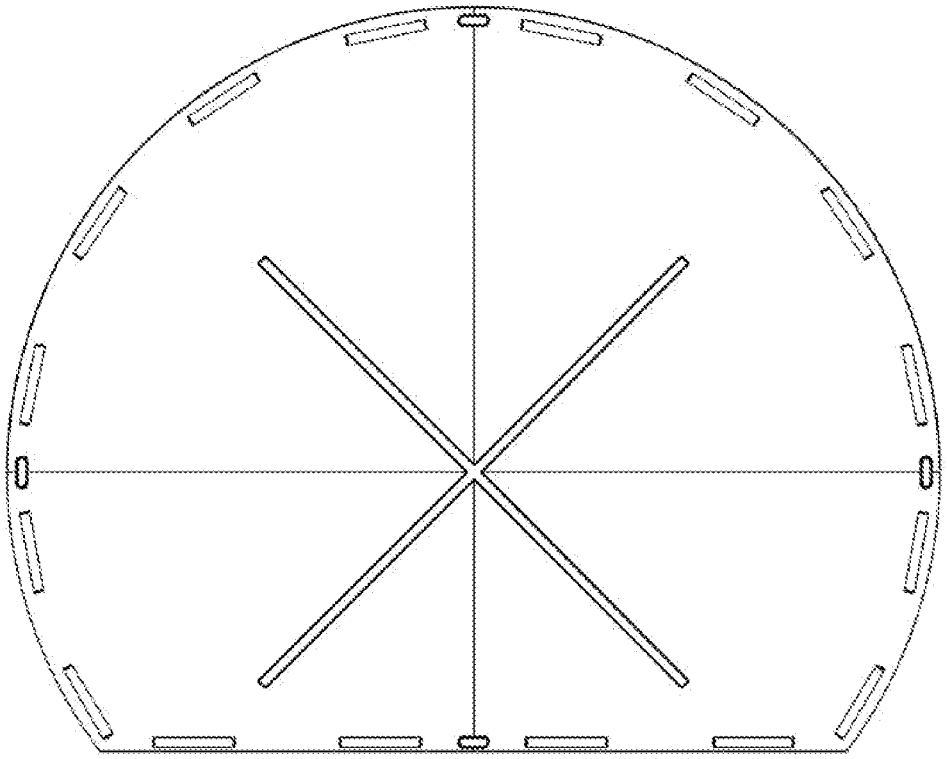
FIG. 42 is a top view of FIG. 40.
Figure 43:
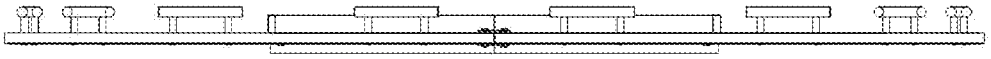
FIG. 43 is a front view of FIG. 40.
Figure 44:
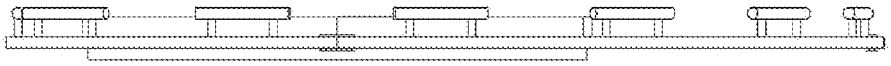
FIG. 44 is a side view of FIG. 40.
Figure 45:
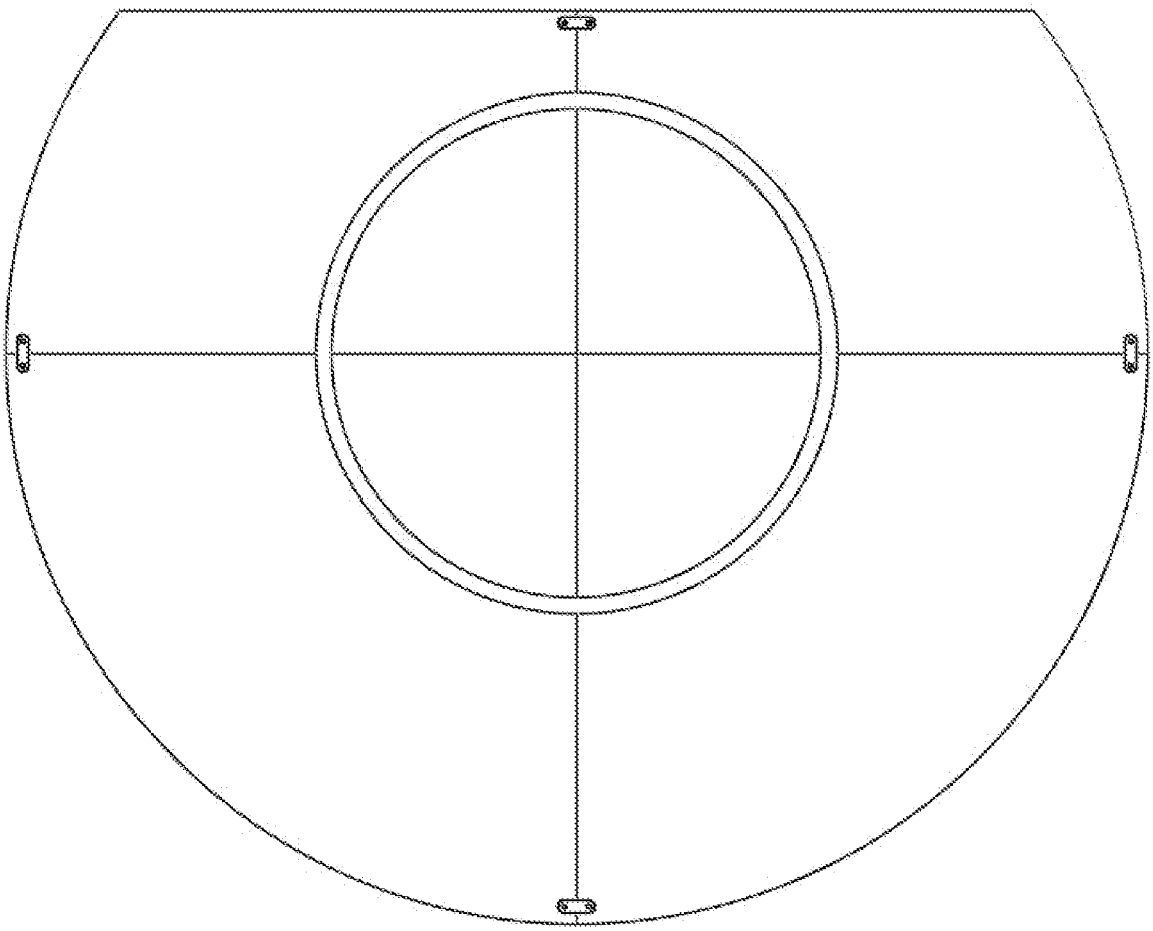
FIG. 45 is a bottom view of FIG. 40.
Figure 46:
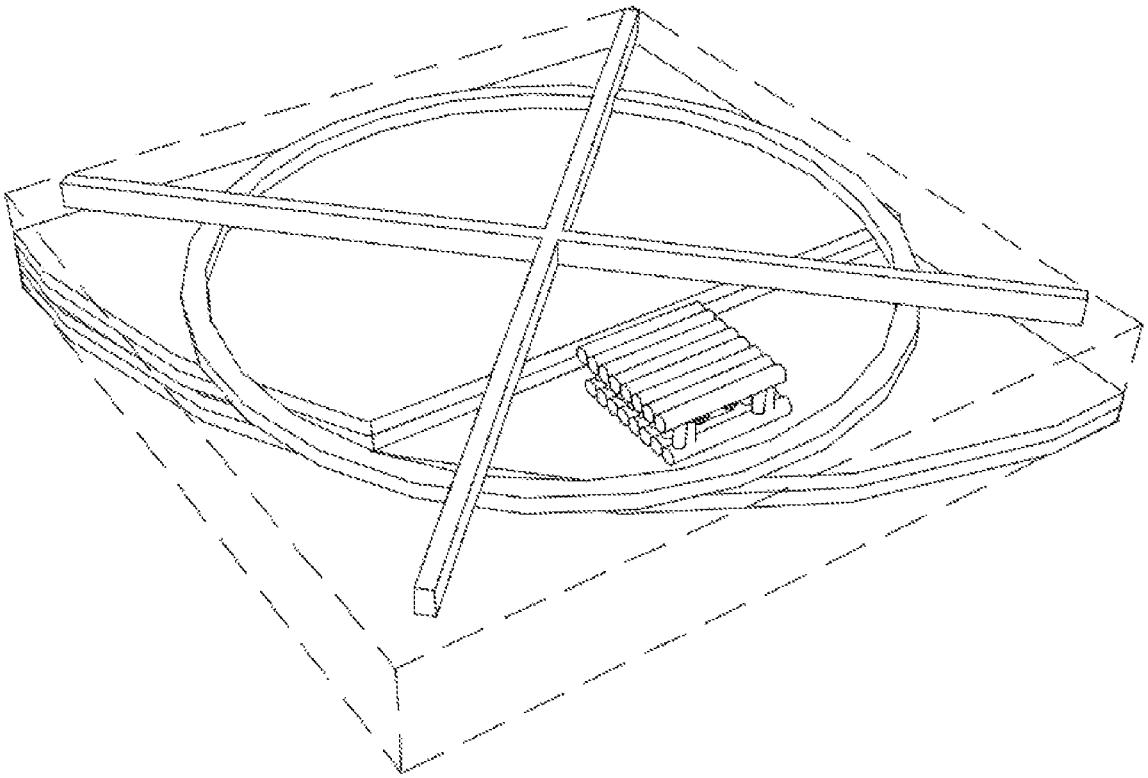
FIG. 46 is a disassembled perspective view of FIG. 40 showing the device packaged for shipping.

In another embodiment of the present invention shown in FIGS. 40-46. FIG. 40 Exploded view, FIG. 41 perspective view, FIG. 42 top view, FIG. 43 front view, FIG. 44 side view, FIG. 45 bottom view, and FIG. 46 shipping view. Platform 87 of under-bed storage unit is generally made from multiple pieces, round 90 with a flat end (edge) 91. It is usually advantageous for ease of transport FIG. 46 to provide platform 87 in two or more parts. As seen in FIGS. 40-46, this may be accomplished by providing a platform 87 having four parts, 87*a*, 87*b*, 87*c*, and 87*d*. A support/connection unit 85 and platform struts 88 are provided for assembling 87*a-d*, and unit 85 and 87 can ride and rotate around on a bearing 89. Handles (bumpers) 86 are used around the border of the platform. A stop mechanism can be used to keep the chord edge flush with the bedframe or open at different points of rotation. Alternate embodiments of the platform 87 are possible and should be considered within the scope of the present invention.

The present invention contemplates what could be categorized as a "lazy susan" approach to under-bed storage. However, in the first place, use of any similar structures for use under a bed is previously unknown. Secondly, a traditional lazy susan is typically constructed in one of two ways: (1) a tabletop lazy susan, such as would be used to retain and share condiments or the like, or (2) a cabinet type lazy susan connected to the bottom and top surfaces of a cabinet interior.

In the case of a tabletop device, a top platform is connected to the top of a bearing structure and the platform/bearing combination is seated on a base structure so that it may rotate freely. The base may or may not be connected to the surface on which it sits.

A cabinet type device requires the axis pole to be connected with both the top and bottom of the cabinet for stability. The platforms are typically seated on mounts, not bearings, and each platform is secured to the mounts with a retention ring or the like.

The structure of the present invention, however, is free-standing. It does not sit on a bearing and base structure as with a tabletop device. It also does not require connection to an existing surface, as with a cabinet type device. A free-standing unit is currently considered the best mode of practicing the invention, though other inventive designs and configurations are envisioned and are disclosed herein.

The unit of the present invention is designed specifically for use with under-bed storage units, though may certainly be suitable for other applications. It should also be noted that other structures not specifically disclosed may readily fall within the purview of the invention and should be understood to be covered by the present disclosure.

The invention claimed is:

1. An under-bed storage unit comprising:

a bed frame;

a platform comprising a major circular segment defined by an arc edge and a chord edge;

a support structure perpendicular to and extending through a center of said platform;

wherein said platform has a diameter no larger than a smallest dimension of a planar surface of said bed frame, and wherein said chord edge is normally flush with a margin of said bed frame.

2. The storage unit of claim 1, wherein said support structure is mounted to said bed frame and comprises a base, a shaft assembly, and a center support component.

3. The storage unit of claim 2, wherein said center support component is fixed to said platform.

4. The storage unit of claim 2, wherein a rotating assembly is interposed between said base and said shaft assembly.

5. The storage unit of claim 2, wherein a rotating assembly is interposed between said shaft assembly and said platform.

6. The storage unit of claim 1, wherein said chord edge has a lip extending upward from said chord edge.

7. The storage unit of claim 1, wherein said arc edge has a lip extending upward from said arc edge.

8. The storage unit of claim 2, wherein said shaft assembly further comprises a spacer, a lower bearing, a lower bearing race, a center support mount carrying said center support component, an upper bearing race, an upper bearing, a clamp, and platform connectors.

9. An under-bed storage unit comprising:

a platform comprising a major circular segment defined by an arc edge and a chord edge;

a large low-profile bearing centered below said platform: wherein said platform has a diameter no larger than a smallest dimension of a planar surface of a selected bed frame, and wherein said bearing has a diameter no larger than a smallest diameter of said platform, and wherein said chord edge is normally flush with a margin of said selected bed frame.

10. The storage unit of claim 9, wherein said bearing is freestanding.

11. The storage unit of claim 10, wherein said bearing is fixed to said platform.

12. The storage unit of claim 9, wherein said chord edge has a lip extending upward from said chord edge.

13. The storage unit of claim 9, wherein said arc edge has a lip extending upward from said arc edge.

14. An under-bed storage unit comprising:

a bed frame;

a platform comprising a major circular segment defined by an arc edge and a chord edge;

a large low-profile bearing centered below said platform: wherein said platform has a diameter no larger than a smallest dimension of a planar surface of said bed frame, and wherein said bearing has a diameter no larger than a smallest diameter of said platform, and wherein said chord edge is normally flush with a margin of said bed frame.

15. The storage unit of claim 14, wherein said bearing is mounted to said bed frame.

16. The storage unit of claim 15, wherein said bearing is fixed to said platform.

17. The storage unit of claim 14, wherein said chord edge has a lip extending upward from said chord edge.

18. The storage unit of claim 14, wherein said arc edge has a lip extending upward from said arc edge.

19. A method of furnishing under-bed storage comprising the steps of:

providing at least one circular platform generally parallel to a bed frame;

placing said platform under said bed frame such that a linear chord edge of said platform is flush with a margin of said bed frame and a circular segment of said platform is covered by said bed frame;

providing a freestanding bearing support below said platform and located in a center of said platform;

rotating said platform on said support such that said chord edge is not flush with said margin of said bed frame and said circular segment extends beyond said margin of said bed frame.

20. The method of claim 19, wherein said platform is divided into smaller pieces for shipping.

21. The method of claim 19, further comprising providing said at least one circular platform including two platforms parallel to one another and to said bed frame.

22. The method of claim 19, wherein said platform includes a plurality of dividers.

23. The method of claim 19, wherein said platform includes a plurality of external drawers.

24. The method of claim 19, further comprising the step of providing said platform with a plurality of bumpers.

25. The method of claim 19, further comprising the step of providing said chord edge with a lip extending upward from an edge of said chord edge.

26. The method of claim 19, further comprising the step of providing said circular segment with a lip extending upward from an edge of said circular segment.

27. The method of claim 19, further comprising the step of providing said platform with a plurality of dividers.

28. The method of claim 19, further comprising the step of providing said platform with a plurality of external drawers.

29. The method of claim 19, wherein said support is configured to be freestanding and supported on a bearing.

* * * * *